US005717384A

United States Patent [19]

Johnson et al.

[11] Patent Number: 5,717,384

[45] Date of Patent: Feb. 10, 1998

[54] WARNING DEVICE FOR PRINTERS

[75] Inventors: Rodney W. Johnson, Mobile, Ala.; James A. Stokes, III, Sunnyvale, Calif.

[73] Assignee: QMS, Inc., Mobile, Ala.

[21] Appl. No.: 656,890

[22] Filed: May 30, 1996

[51] Int. Cl.[6] ..... G08B 21/00

[52] U.S. Cl. ..... 340/660; 340/635; 340/661; 355/206; 371/48; 395/113

[58] Field of Search ..... 340/660, 635, 340/661; 371/22.1, 22.3, 48; 395/113, 114, 116; 355/200, 206; 101/484

[56] References Cited

U.S. PATENT DOCUMENTS

| | | | |
|---|---|---|---|
| 3,701,019 | 10/1972 | Jackson | 371/48 |
| 4,255,669 | 3/1981 | Naugle | 340/661 |
| 4,574,276 | 3/1986 | Sato | 340/661 |
| 4,621,343 | 11/1986 | Fujieda et al. | 395/113 |
| 4,843,378 | 6/1989 | Kimura | 340/635 |
| 4,996,487 | 2/1991 | McSparran et al. | 324/549 |
| 5,008,655 | 4/1991 | Schlesinger et al. | 340/635 |
| 5,023,631 | 6/1991 | Negishi et al. | 346/154 |
| 5,073,786 | 12/1991 | Shimada et al. | 346/76 |
| 5,132,628 | 7/1992 | Matsuo | 340/635 |
| 5,164,767 | 11/1992 | Suzuki | 355/200 |
| 5,218,353 | 6/1993 | Okumura et al. | 340/815.01 |
| 5,227,766 | 7/1993 | Endo | 340/635 |
| 5,250,986 | 10/1993 | Axten et al. | 355/206 |
| 5,307,049 | 4/1994 | Uchida et al. | 340/507 |
| 5,365,311 | 11/1994 | Matsuoka | 355/205 |

*Primary Examiner*—Thomas Mullen
*Assistant Examiner*—John Tweel, Jr.
*Attorney, Agent, or Firm*—Webb Ziesenheim Bruening Logsdon Orkin & Hanson, P.C.

[57] ABSTRACT

A modular peripheral error warning device for use with printers having a CENTRONICS parallel port. The peripheral error warning device monitors various voltages of connecting wires that interface with the computer and the printer and includes an interface box, an alarm box and a power supply. Activation of an alarm, such as a buzzer or LED, will occur if the monitored voltage corresponds to printer error, such as a paper jam. Correction of the printer error results in deactivation of the alarm.

20 Claims, 6 Drawing Sheets

WARNING DEVICE FOR PRINTERS

BACKGROUND OF THE INVENTION

1) Field of the Invention

The present invention relates to warning devices and, more particularly, to warning devices for printers.

2) Description of the Prior Art

With the advent of personal computers, desktop printing or publishing has become standard for publishing letters, reports, engineering drawings and the like. Typically, the person using the computer requires a hard copy of the information displayed and/or stored on the computer. The printer, which is interfaced with the computer, prints the hard copy through appropriate software.

Generally speaking, printers today operate flawlessly, except for occasional paper jams and the continual replacement of ink and paper, which cause the printer to go offline. When one of these conditions occurs, a warning message appears on the computer screen and at times a message, such as "Paper Jam", will appear on a printer liquid crystal display (LCD) panel. In the office setting, the printer is located generally in close proximity to the personal computer and the user can then quickly correct many printer problems, such as a paper jam. However, in a factory setting or in an office network, an employee at the computer terminal may send the information to a printer that is remote from the employee operating the computer. The employee must leave his or her workstation to retrieve the printed material and will have no idea whether the printer jammed or ran out of paper until he or she reaches the printer and learns that the job was not printed. A further problem results if that employee is not authorized to correct the printer error, in which case the employee must then locate the authorized person.

U.S. Pat. No. 5,164,767 discloses an external warning device for use with a copying machine. However, a portion of the warning device is integral with the copy machine. A problem with this arrangement is that it limits the purchaser to only those machines which incorporate such a warning device.

Therefore, it is an object of the present invention to provide a printer warning device that can be retrofitted to a variety of printers so as to notify individuals when the printer goes offline.

SUMMARY OF THE INVENTION

The present invention is a warning device for detecting a printer error where a printer is electrically connected to a computer via a cable made up of a plurality of connecting wires and includes an interface module and an alarm. The interface module includes a cable that is adapted to electrically couple to the connecting wires and includes a plurality of interfacing wires that are adapted to interface with the connecting wires. One or more tapping wires connect to one or more of the interfacing wires. A computing device, such as a programmable logic device (PLD), receives electrical signals from the one or more tapping wires. The computing device determines the printer state from the received electrical signals and transmits an activation signal if the printer is in an error state. An alarm electrically couples to the computing device, where the alarm is activated by the activation signal.

The present invention is also a method for detecting a printer error where the printer is electrically connected to a computer via a cable made up of a plurality of wires that include the steps of: a) monitoring the electrical state of at least one of the wires; (b) determining whether the electrical state of the wire indicates a normal state or printer error state; and (c) activating an alarm if the determined electrical state of the wire indicates a printer error state.

DESCRIPTION OF THE PREFERRED EMBODIMENT

Figure 1:
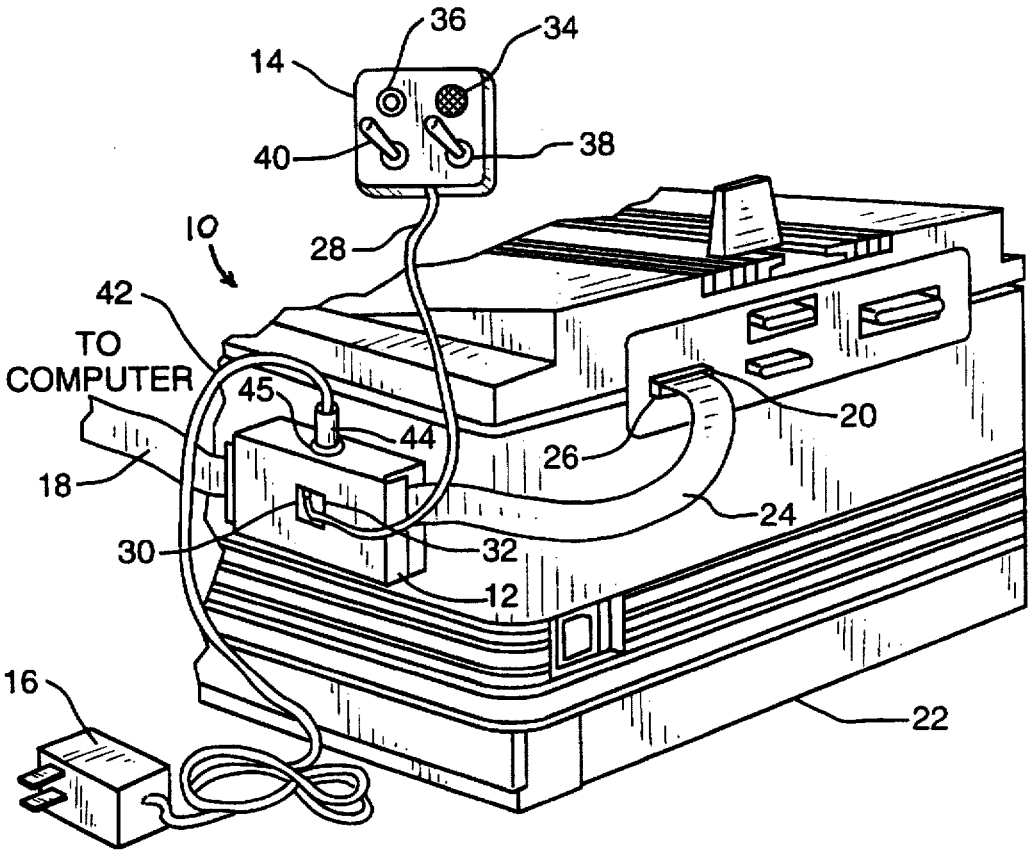
FIG. 1 is a perspective view of a warning device made in accordance with the present invention coupled to a printer.
Figure 2:
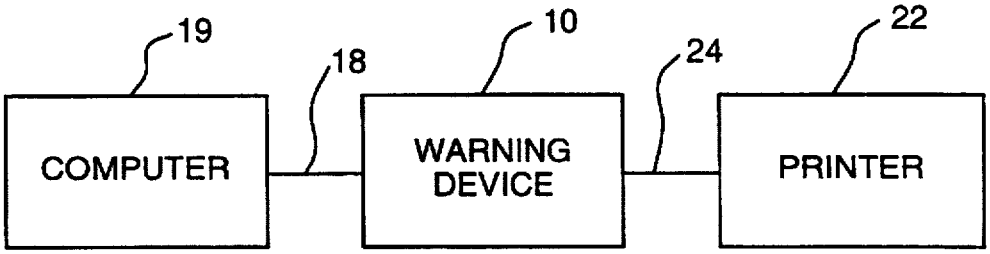
FIG. 2 is a schematic view of a system utilizing the warning device of the present invention.

FIGS. 1 and 2 show a modular warning device 10 made in accordance with the present invention. The warning device 10 includes an interface box 12, an alarm box 14 and a power adapter 16 which is preferably a five volt power supply. The warning device 10 interfaces between cable 18 from computer 19. Normally, cable 18, which includes a male connector, would be received by a female connector 20 of a printer 22. The interface box 12 includes a female connector 23 for receipt of the male connector of cable 18, and includes a hard wire cable 24 having a male connector 26, which is received by the female connector 20 of the printer 22. The female connector 20 of the printer 22 is a CENTRONICS parallel port, an industry standard that corresponds each pin of the parallel port to a certain function, such as data transmission or printer error signals.

The alarm box 14 is electrically coupled to the interface box 12 via cable 28. One end of cable 28 includes male connector jack 32 received by female connector jack 30 of the interface box 12. The alarm box 14 includes a light or LED 34, a buzzer 36 and switches 38 and 40, which activate or deactivate the LED 34 and buzzer 36. The five volt power supply 16 includes two prongs for engagement with a power receptacle and a cable 42 having male connector jack 44 removably received by female connector jack 45 of the interface box 12. The five volt power supply 16 converts 120 volts AC to five volts DC in a manner well-known in the art. As can be seen, warning device 10 is completely modular, in that the cable 18 is removably received by female connector 23, and male connector 26 of interface cable 24 is removably received by the female connector 20 of the printer 22. The respective connectors of the five volt power supply 16 and alarm box 14 are likewise removably secured to the interface box 12. The lengths of cables 24, 28 and 42 can be varied for specific applications.

Figure 3:
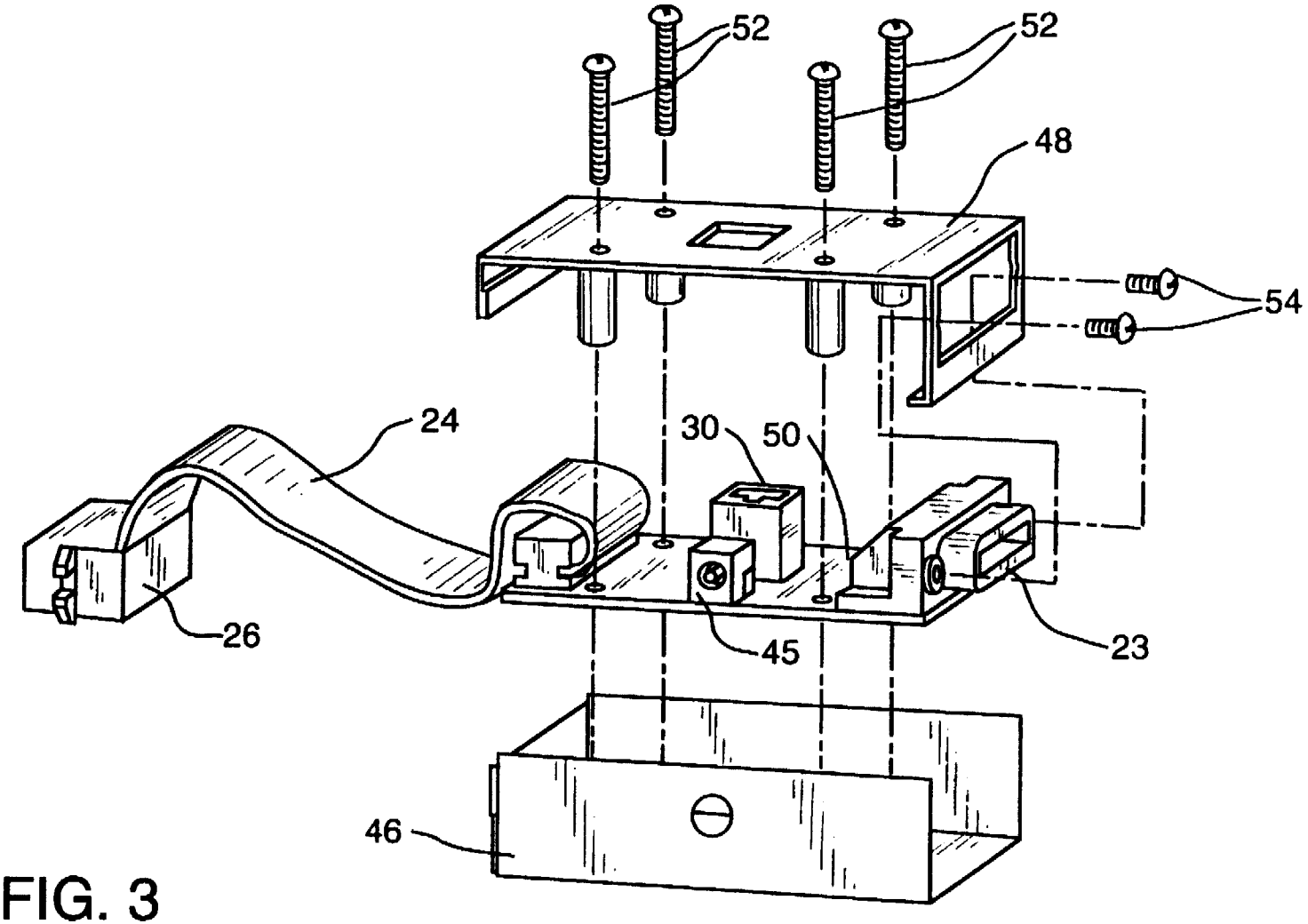
FIG. 3 is an exploded perspective view of an interface box of the warning device shown in FIG. 1.
Figure 4A:
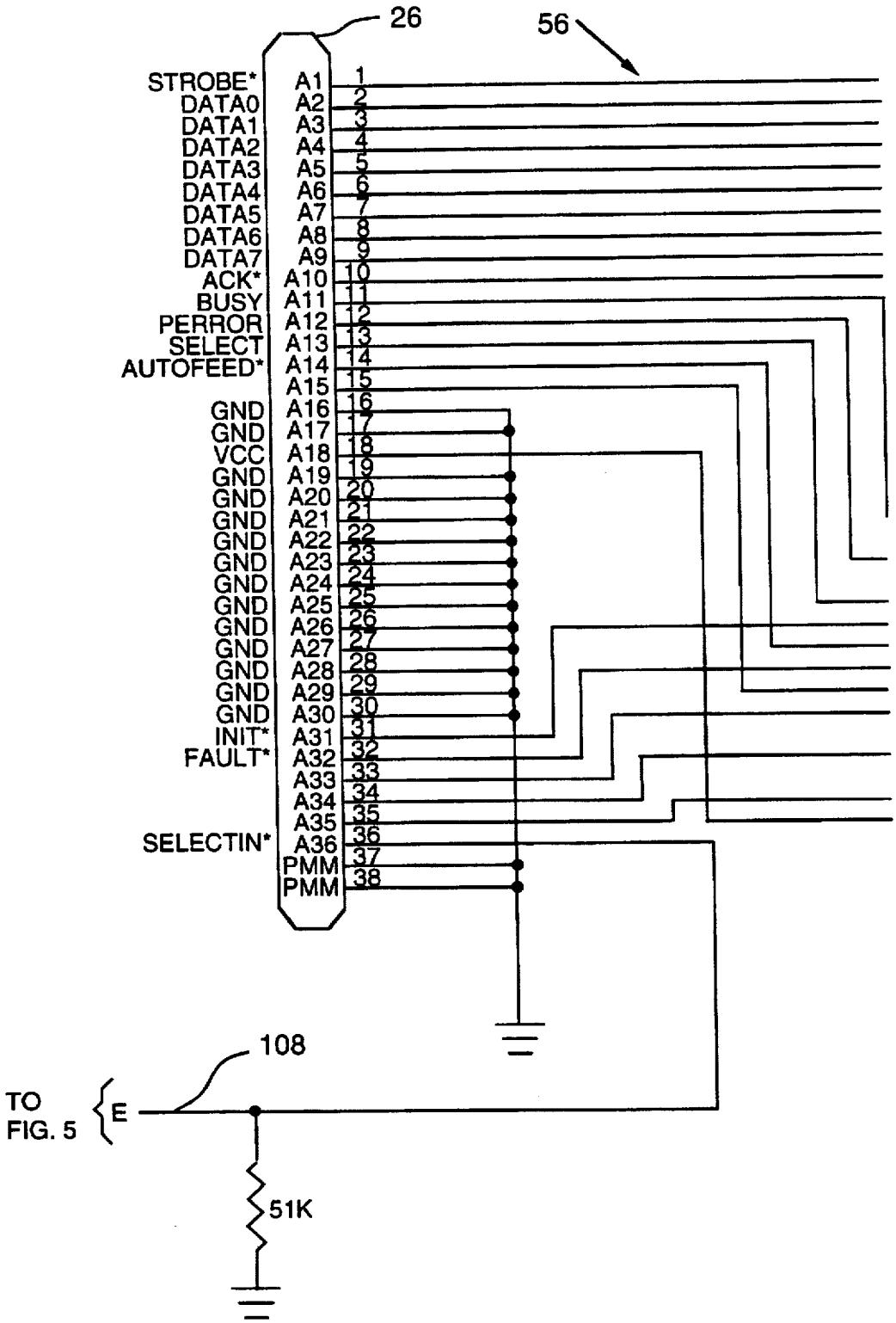
FIG. 4 is a schematic view of a portion of the ribbon cable of the warning device shown in FIG. 1.
Figure 4B:
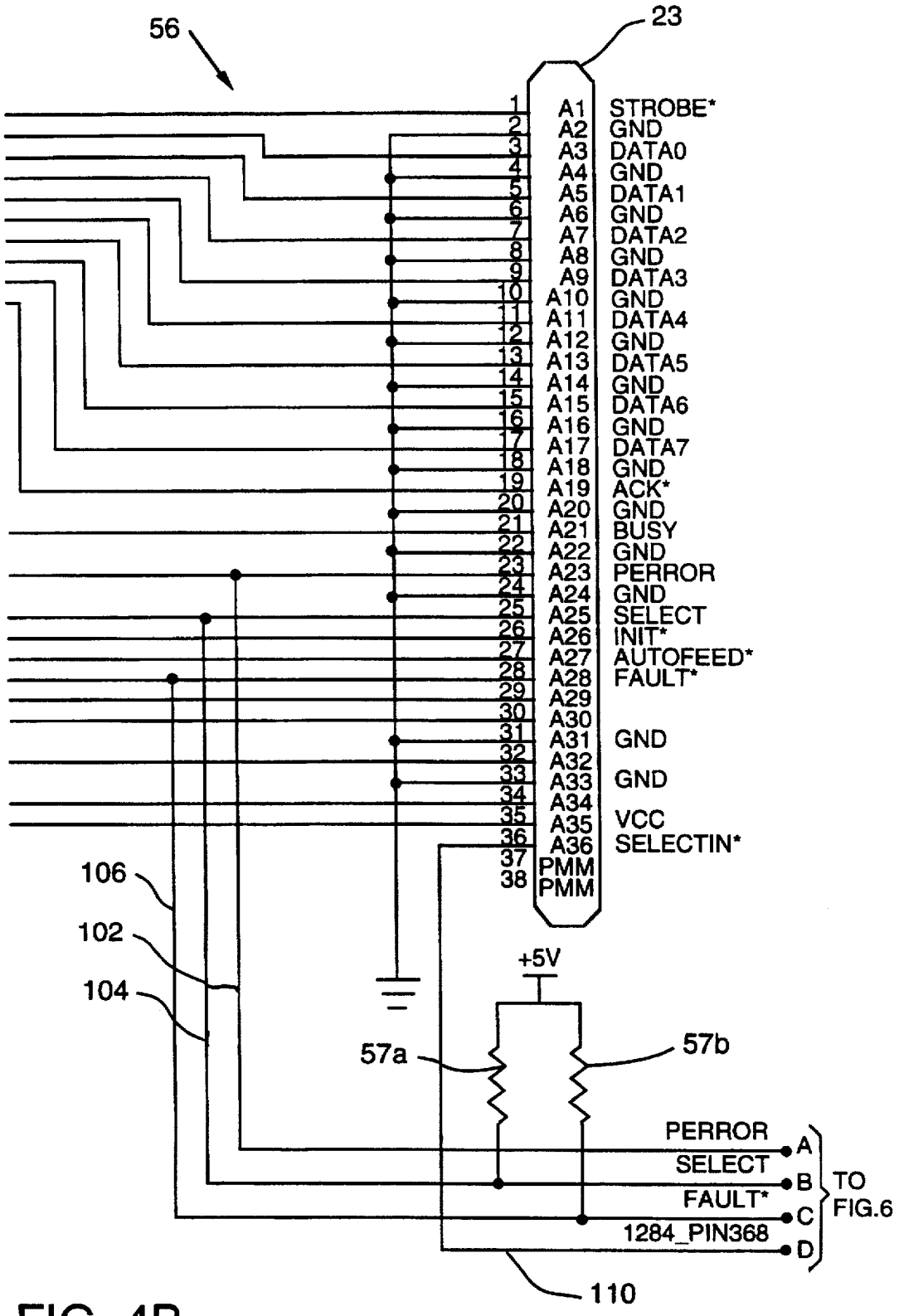

Referring to FIG. 3, the interface box 12 includes a base 46, a top plate 48 and a printed circuit board 50. The printed circuit board 50 is sandwiched between the top plate 48 and the base 46, which are held together by screws 52 and 54. One end 27 of the ribbon cable 24 is hard wired to the printed circuit board 50 and the other end is connected to the thirty-six pin male connector 26 for interfacing with the parallel port of female connector 20 of printer 22. The thirty-six pin parallel port female connector 23 is attached to the printed circuit board 50 for interfacing with the computer 19 through the cable attached thereto. Female connector jacks 30 and 45 are connected to the printed circuit board 50. The printed circuit board 50 includes a plurality of layout tracings 56 (which are schematically shown in FIG. 4) and the various electrical components discussed below.

In the preferred embodiment, connectors 23 and 26 are electrically coupled through the printed circuit board 50 in a similar fashion as if ribbon cable 24 directly connected connectors 23 and 26. As shown in FIG. 4, wires 102, 104 and 106 tap into wires on the printed circuit board 50 that are used to transmit the PERROR, SELECT, and FAULT* signals, respectively. Wires 108 and 110 are connected to connector positions A36 of connectors 23 and 26, respectively. Connector positions A36 carry the SELECTIN* signal. Generally, all printers using a CENTRONICS parallel port use the PERROR, SELECT and FAULT* signals to transmit information to the computer about the printer state, whether it is a paper jam or other online occurrence. The five volt power supply 16 is connected through resistors 57*a* and 57*b* to wires 104 and 106, which prevent the light 34 and buzzer 36 from becoming activated if power is applied to the warning device 10 before it is connected to the printer. The light 34 and buzzer 36 can then be activated after the warning device 10 is connected to the printer 22.

Figure 5:
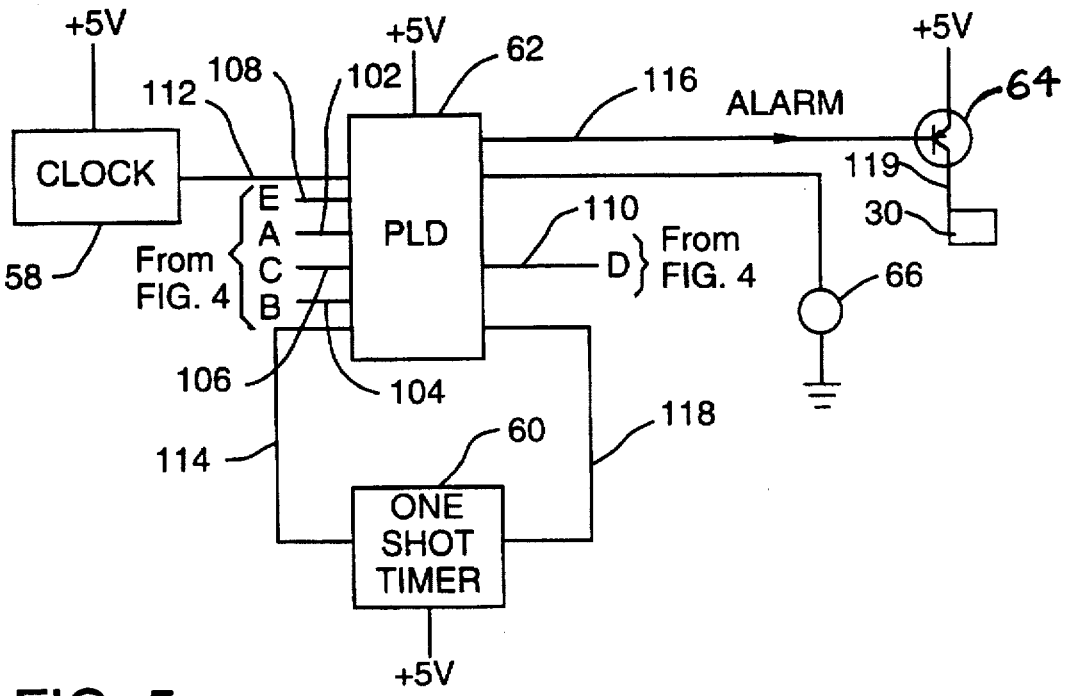
FIG. 5 is a circuit diagram of the interface box electronics of the warning device shown in FIG. 1.

Referring to FIG. 5, the printed circuit board 50 includes a clock 58, a one shot timer 60 and a programmable logic device (PLD) 62 or other type of microprocessor device. The one shot timer 60 creates a one second delay before the alarm is activated so as to avoid intermittent activation. Wires 102, 104, 106 and 108 are connected to the input pins of PLD 62 along with wires 112 and 114 of the clock 58 and the one shot timer 60. Wire 110 is connected to an output pin of PLD 62, along with wire 118 of the one shot timer 60 and alarm wire 116. Alarm wire 116 is connected to the base of transistor 64, which has its emitter connected to the five volt power supply 16. Output wire 119 connects the collector of transistor 64 to the modular female connector jack 32. The five volt power supply 16 also supplies power to the PLD 62, the clock 58, transistor 64 and the one shot timer 60.

Figure 6:
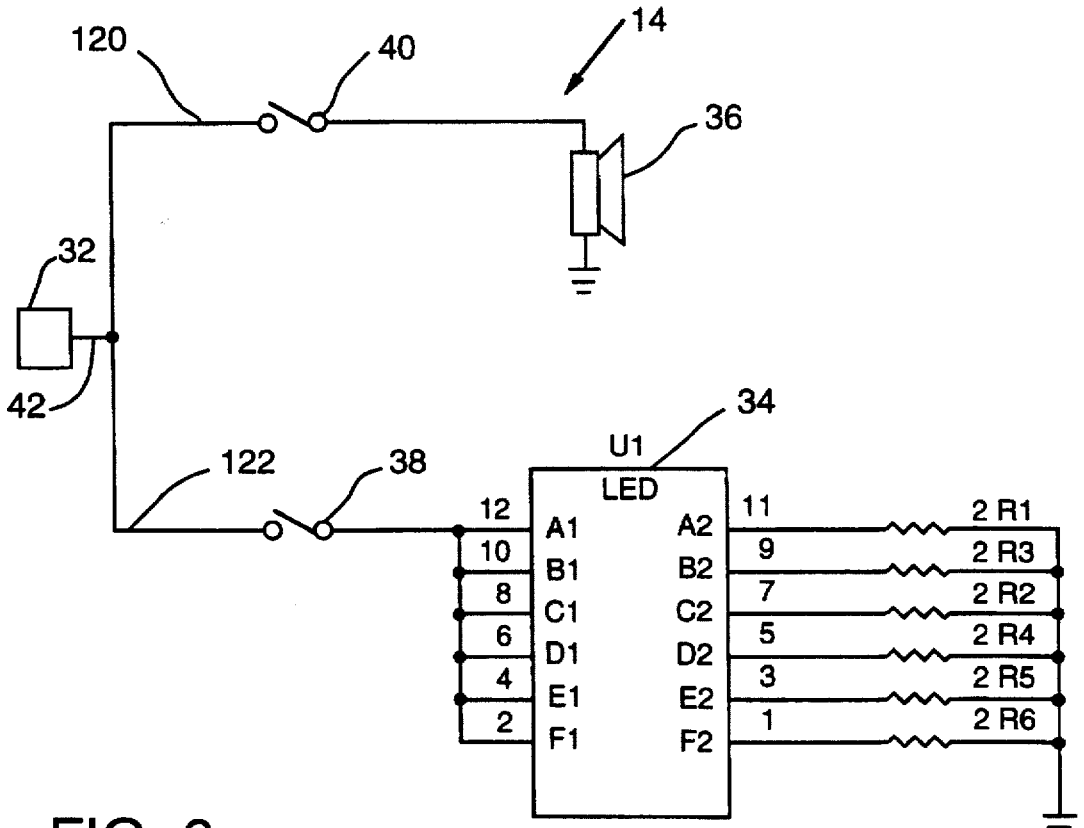
FIG. 6 is a circuit diagram of an alarm box of the warning device shown in FIG. 1.

Referring to FIG. 6, the alarm box 14 includes both the Piezo electric buzzer 36 and an LED 34 which are connected in parallel through wires 120 and 122 to male connector jack 30, which connects to female connector jack 32. Switches 38 and 40 are provided in the wires 120 and 122 to the respective buzzer 36 and LED 34. The buzzer 36 or LED 34 can be disabled by setting the respective switches 38 and 40 in an open position as opposed to the normally closed position.

Figure 7:
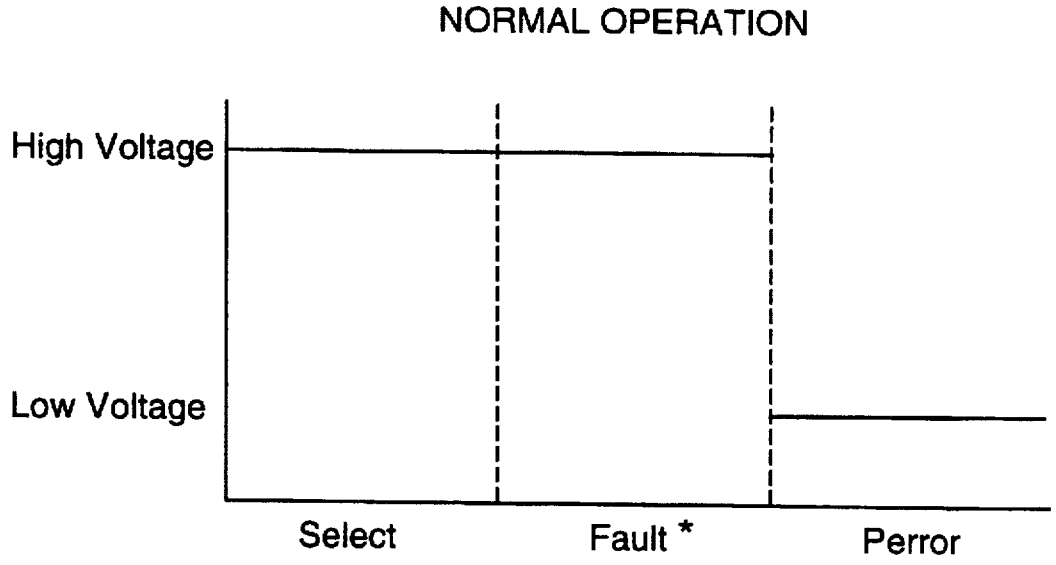
FIG. 7 is a graph showing normal printer states as measured across various cable wires.
Figure 8:
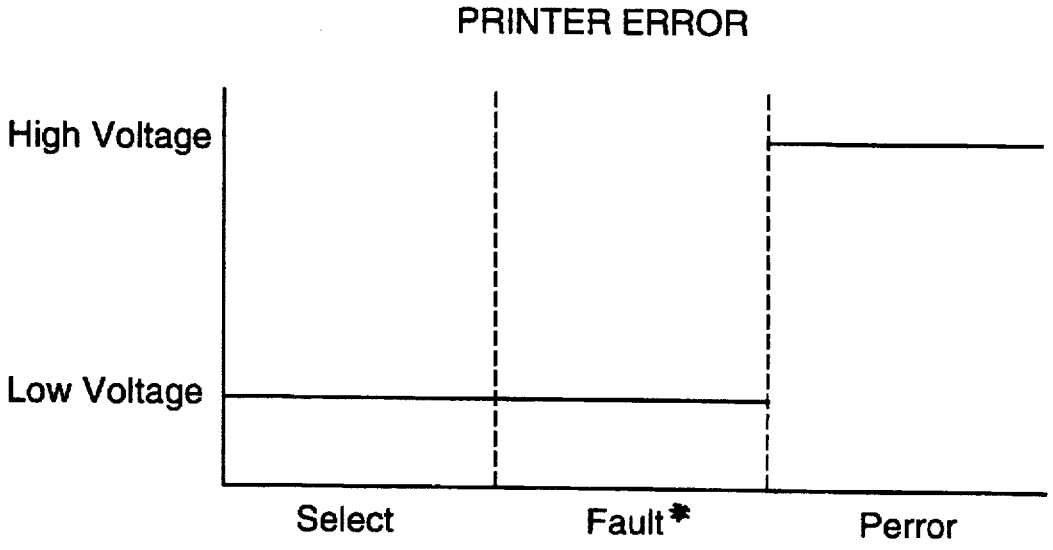
FIG. 8 is a graph showing printer offline states as measured across various cable wires.

Referring to FIG. 7, in normal operation, the SELECT and FAULT* signals are operated at between three to five volts and the PERROR signal operates at between zero to two volts. These voltages indicate that the printer is in an operational state and no printing errors exist, such as a paper jam. Wires 102, 104 and 106 monitor these voltages. However, if the printer jams or runs out of paper and goes offline, then the operating voltages of at least one of the SELECT, FAULT* and PERROR lines will change from a high voltage to a low voltage or from a low voltage to a high voltage, respectively, as shown in FIG. 8, which shows all three of these voltages changed.

The voltages of wires 102, 104 and 106 are measured by the PLD 62 and converted into digital logic, where a corresponding high voltage equals "1" and a corresponding low voltage equals "0". If either the SELECT, FAULT* or PERROR signals change from their normal state to a printer error state, then a small current passes through wire 116 which turns on transistor 64 and allows a current to pass through wire 118 and activate the buzzer 36 and LED 34. The buzzer 36 and LED 34 will become deactivated when the SELECT, FAULT* and PERROR signals return to their normal states, or switches 38 and 40 are opened.

The warning device 10 is adapted to operate in a normal CENTRONICS mode, where the PERROR, SELECT and FAULT* signals operate in only two states: normal and abnormal (i.e., printer online and printer offline). However, several printers use PERROR, SELECT and FAULT* signals for bidirectional communication in a P1284 mode, whereby the voltage across these wires continually varies between a high state and a low state. Connector position A36 of male connector 26 and female connector 23 through which the SELECTIN* signal passes will have a low voltage (zero volts–two volts) if the printer is operating in the CENTRONICS mode, and a high voltage (three volts–five volts) if the printer is operating in the P1284 mode. Wire 108 connects connector position A36 of connector 23 to the PLD 62. Based upon the voltage of wire 108, the PLD 62 determines if the printer is operating in the P1284 mode. If the PLD 62 determines that is the case, then the PLD 62 ignores the states of PERROR, FAULT* and SELECT so that buzzer 36 or LED 34 cannot be activated. A light bulb or LED 66 in the warning device 10 can be provided to indicate when the printer is operating in a P1284 mode.

Figure 9:
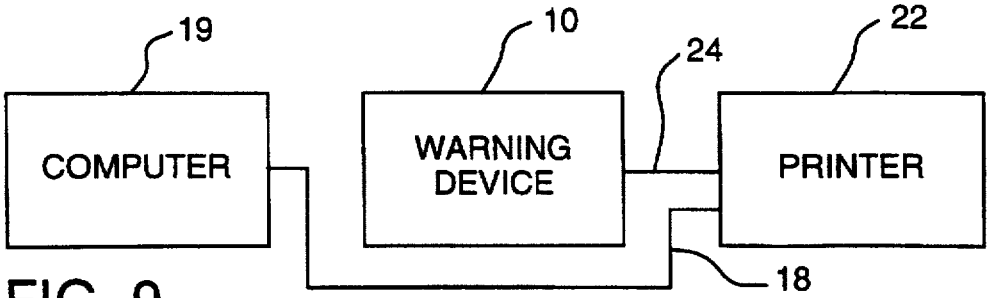
FIG. 9 is a schematic view of a system using the warning device of the present invention.

Although the computer 19 is interfaced to the printer 22 through the parallel port female connector 32, this is not necessary for the warning device 10 to operate. The computer can be directly interfaced to the printer through the printer serial port as schematically shown in FIG. 9. Also, the computer can be connected to the printer by whatever means, i.e., serial port, local talk, Ethernet or Token Ring network. Hence, a computer does not have to be interfaced with female connector 32 for the warning device to operate.

As should now be evident, the warning device 10 can be incorporated with many printers. It is versatile, in that it is small in size, no software changes need to be made to the printer computer and no hardware changes need to be made to the printer. Due to the modularity of the warning device 10, the interface box 12 can be attached to the printer and the alarm box can be positioned, using the appropriate length of cable, at a desired location remote from the printer.

Having described the presently preferred embodiment of the invention, it is to be understood that it may otherwise be embodied within the scope of the appended claims.

We claim:

1. A method for detecting a printer error, comprising the steps of:

a) electrically connecting a printer to a computer via a cable made up of a plurality of wires;

b) electrically tapping a cable wire via a modular warning device;

c) monitoring the electrical state of the cable wire with the modular warning device;

d) determining, via the modular warning device, whether the electrical state of the cable wire indicates a normal state or a printer error state; and e) activating an alarm, via the modular warning device, if the electrical state of the cable wire indicates a printer error.

2. A method for detecting a printer error as claimed in claim 1, further comprising the step of:

providing a tapping wire for connecting the modular warning device to the cable wire.

3. A device for detecting a printer error, where a printer is electrically connected to a computer via a cable made up of a plurality of connecting wires, comprising:

an interface module having a body, means for receiving a computer cable made up of a plurality of wires adapted to be received by the computer and secured to said body, means for receiving a printer cable made up of a plurality of connecting wires adapted to be received by the printer and secured to said body and interfacing wires secured to said body electrically coupled to said computer cable and said printer cable, whereby the computer is electrically coupled to the printer via said computer cable, said printer cable and said interfacing connecting wires;

one or more tapping wires connected to said interfacing wires and attached to said body;

computing means for receiving electrical signals from said one or more tapping wires, said computing means determines the printer state from the received electrical signals and transmits an activation signal if the printer is in an error state; and an alarm electrically coupled to said computing means, said alarm activated by the activation signal, said alarm and said computing means supplied by an electrical source external of said computer cable and said printer cable.

4. A printer system, comprising:

a computer having a computer parallel port;

a computer cable made up of a plurality of wires electrically coupled to said computer parallel port;

an interface module having a body, a plurality of interfacing wires and one or more tapping wires, said computer cable electrically coupled to said body, said plurality of interfacing wires electrically coupled to said computer cable and said tapping wires connected to said interfacing wires;

a printer having a printer parallel port;

a printer cable made up of a plurality of wires electrically coupled to said printer parallel port and electrically coupled to said interfacing wires so that said computer parallel port is electrically coupled to said printer parallel port; and computing means for receiving electrical signals from said tapping wires, said computing means determines the printer state from said electrical signal and transmits an activation signal if the printer is in an error state, said computing means attached to said body.

5. A method for detecting a printer error, where said printer is electrically connected to a computer via a cable made up of a plurality of wires, comprising the steps of:

a) monitoring the electrical states of a first wire and a second wire externally of the printer and the computer;

b) determining whether the electrical state of the first wire indicates a normal state or a printer error state;

c) determining whether the electrical state of the second wire indicates a normal state or an override state; and d) activating an alarm if the determined electrical state of the first wire indicates a printer error state and the determined electrical state of the second wire is in a normal state.

6. A method for detecting a print error as set forth in claim 5, wherein the normal state is a CENTRONICS mode and the override state is a P1284 mode.

7. A method for detecting a printer error as claimed in claim 1, wherein the printer includes a CENTRONICS parallel port.

8. A method for detecting a printer error as claimed in claim 1, wherein said alarm includes at least one of a light and a buzzer.

9. A method for detecting a printer error as claimed in claim 1, further comprising monitoring the electrical states of several wires;

determining whether the electrical state of any of the monitored wires indicates a normal state or a printer error state; and activating the alarm, if any of the determined electrical states of the monitored wires indicate a printer error state.

10. A method for detecting a printer error as claimed in claim 1, further comprising:

monitoring the state of a second wire;

determining whether the second wire is in a normal electrical state or an override electrical state; and preventing activation of the alarm if the second wire is in an override electrical state.

11. A method for detecting a printer error as claimed in claim 2, wherein the monitoring of the electrical state of at least one of the wires is conducted by monitoring the voltage of the tapping wire.

12. A device as claimed in claim 3, wherein said connecting wires are arranged for connecting to a CENTRONICS parallel port.

13. A device as claimed in claim 3, wherein said alarm includes an audible alarm and a light source both electrically coupled to said computing means and activated by the activation signal.

14. A device as claimed in claim 13, wherein two disabling switches are electrically coupled to said audible alarm and said light source, respectively.

15. A device as claimed in claim 3, wherein said connecting wires are connected to parallel port connectors.

16. A device as claimed in claim 3, further comprising override wires electrically coupled to said computing means and adapted to be connected to the printer, whereby an override electrical signal passing through said override wires prevents said computing means from issuing an activation signal.

17. A device as claimed in claim 3, wherein said computing means is electrically coupled to a transistor and said alarm is electrically coupled to said transistor.

18. A device as claimed in claim 3, wherein said computing means is a programmable logic device.

19. A printer system as claimed in claim 4, further comprising:

a power supply electrically coupled to said alarm and said interface module, wherein said power supply, said interface and said alarm are modular.

20. A printer system as claimed in claim 4, wherein said computer includes a CENTRONICS parallel port which is electrically coupled to said printer through said interface module.

* * * * *